US006857704B2

(12) United States Patent
Stenzel et al.

(10) Patent No.: US 6,857,704 B2
(45) Date of Patent: Feb. 22, 2005

(54) NECK SUPPORT FOR A CHAIR

(75) Inventors: Thomas Stenzel, Waldshut (DE); Michael Klaesener, Waldshut (DE); Klaus Maier, Dachsberg (DE)

(73) Assignee: Sedus Stoll AG, Waldshut-Tiengen (DE)

( * ) Notice: Subject to any disclaimer, the term of this patent is extended or adjusted under 35 U.S.C. 154(b) by 3 days.

(21) Appl. No.: 10/620,381

(22) Filed: Jul. 17, 2003

(65) Prior Publication Data

US 2004/0070252 A1 Apr. 15, 2004

(30) Foreign Application Priority Data

Aug. 25, 2002 (EP) ..... 02018937

(51) Int. Cl.[7] ..... B60N 2/48
(52) U.S. Cl. ..... 297/408; 297/410
(58) Field of Search ..... 297/391, 408, 297/410

(56) References Cited

U.S. PATENT DOCUMENTS

| | | | | | |
|---|---|---|---|---|---|
| 2,045,225 | A | * | 6/1936 | Glascow | 297/408 |
| 2,586,417 | A | * | 2/1952 | Cole | 297/409 |
| 2,740,467 | A | * | 4/1956 | Page | 297/409 |
| 3,477,761 | A | * | 11/1969 | Krantz | 297/409 |
| 3,885,831 | A | | 5/1975 | Rasmussen | |
| 4,335,920 | A | * | 6/1982 | Hirth | 297/408 |
| 5,177,823 | A | * | 1/1993 | Riach | 5/636 |
| 6,155,643 | A | | 12/2000 | Gorgi et al. | |
| 6,397,414 | B1 | * | 6/2002 | Lloyd | 5/622 |
| 6,520,585 | B1 | * | 2/2003 | Georg et al. | 297/408 |
| 6,718,582 | B1 | * | 4/2004 | Tinsley | 5/640 |

FOREIGN PATENT DOCUMENTS

| | | | |
|---|---|---|---|
| DE | 2 004 731 | | 9/1971 |
| DE | 2 115 220 | | 10/1972 |
| DE | 196 50 321 | | 6/1998 |
| EP | 0152867 | * | 8/1985 |
| EP | 0 716 951 | | 6/1996 |
| EP | 1 192 880 | | 4/2002 |

* cited by examiner

*Primary Examiner*—Peter R. Brown
(74) *Attorney, Agent, or Firm*—Oblon, Spivak, McClelland, Maier & Neustadt, P.C.

(57) ABSTRACT

In a neck support for a chair, a head cushion is articulated, via an articulation bearing, on a guide sleeve displaced on a retaining bar, articulated on the top edge of a backrest via a further articulation bearing, the retaining bar and the guide sleeve being of rectilinear design, this resulting in linear height adjustability of the neck support. The bottom articulation bearing and preferably also the top articulation bearing each comprise a cylinder on the retaining bar and two cylinders on a bearing foot or on a link plate, it being possible for the first cylinder to rotate in a controlled manner between the two second cylinders via blocks.

6 Claims, 4 Drawing Sheets

NECK SUPPORT FOR A CHAIR

DESCRIPTION

1. Technical Field

The invention relates to the field of seating furniture, in particular to a neck support for an office chair.

2. Prior Art

In particular in the office, it is important for it to be possible for the user of a chair to relax repeatedly from the sitting position which he/she assumes while working. For this purpose, it is necessary not just to open the angle between the upper and lower parts of the body by leaning back, but also to allow the head and neck to rest. The neck support is used for this purpose.

A neck support for an office chair is known, for example, from EP 1,192,880 A2. In the case of this neck support, a retaining bar is attached in an articulated manner on the rear side of the backrest of the chair, and a guide sleeve slides on this retaining bar, the head cushion being fastened at the top end of said guide sleeve. The retaining bar and guide sleeve are designed in the form of circle arcs. The distance between the head cushion and the user's head or neck is changed predominantly by pivoting the retaining bar about the articulation bearing on the backrest. In addition, however, such a change is also made during a height adjustment of the head cushion, by sliding the guide sleeve on the retaining bar, on account of the circle-arc-like movement path.

Although the known design has proven successful in practice, it is not completely satisfactory from an aesthetic point of view since fitting the articulation bearing on the backrest disturbs the uniform appearance of the same. Furthermore, the production outlay is not insignificant, and the adjustment of the distance between the head cushion and the user's head by virtue of the height adjustment over a circular path is not sufficiently flexible.

Another neck support is known from EP 1,186,257 A2. In the case of this neck support, a circle-arc-like retaining bar is articulated on the top edge of the backrest, it being possible for a likewise circle-arc-like guide sleeve, which is integrated in the head cushion, to slide up and down on said retaining bar.

This neck support has also proven successful in practice, but, like the first-mentioned neck support, has the disadvantage that the distance between the head cushion and the user's head cannot be adjusted over an optimally wide range.

Another neck support is known from DE 20 04 731 A. The neck support can be adjusted about two pivot pins which are fitted in an axis-parallel manner to one another and of which one extends within the backrest of the seat and the other extends within the head support.

A similar neck support, which is likewise intended for car seats, is known from DE 21 15 220 A. Here, the head support is connected to the backrest via a pivot pin in each case and a central component comprising two tubular components which can slide one inside the other.

Although these known neck supports have an adjustment range which is sufficient for car seats, they cannot be used for chairs, on account of the requirements which have to be met by the latter differing vastly from those which have to be met by car seats.

DESCRIPTION OF THE INVENTION

The object of the invention is thus to develop a neck support for a chair, in particular an office chair, such that it, on the one hand, can be fitted discreetly on the backrest in an aesthetically pleasing manner, and without excessive production and installation outlay but, on the other hand, nevertheless has a wide adjustment range for the user's head. In particular, the neck support should also have these properties when installed on a height-adjustable and tiltable backrest.

This object is achieved by the features of claim 1 and of the subclaims.

The invention is based on the idea of attaching a rectilinear retaining bar in an articulated manner on the top edge of the backrest and of providing a rectilinear guide sleeve in a displaceable manner on this retaining bar, the head cushion being articulated at the top end of said guide sleeve. The pivoting range of the retaining bar should be approximately 35° in the forward direction, from the direction of the backrest, and that of the head cushion should be approximately 40°. Based on this fundamental concept, the neck support may then be configured in detail such that it can be produced and installed in an aesthetically pleasing manner, and without high outlay, and, in particular together with a backrest which can be adjusted in respect of height and inclination, provides an optimum adjustment range for the user.

BRIEF DESCRIPTION OF THE DRAWINGS

The invention is explained in more detail hereinbelow with reference to an exemplary embodiment illustrated in drawings, in which.

METHODS OF IMPLEMENTING THE INVENTION

Figure 1:
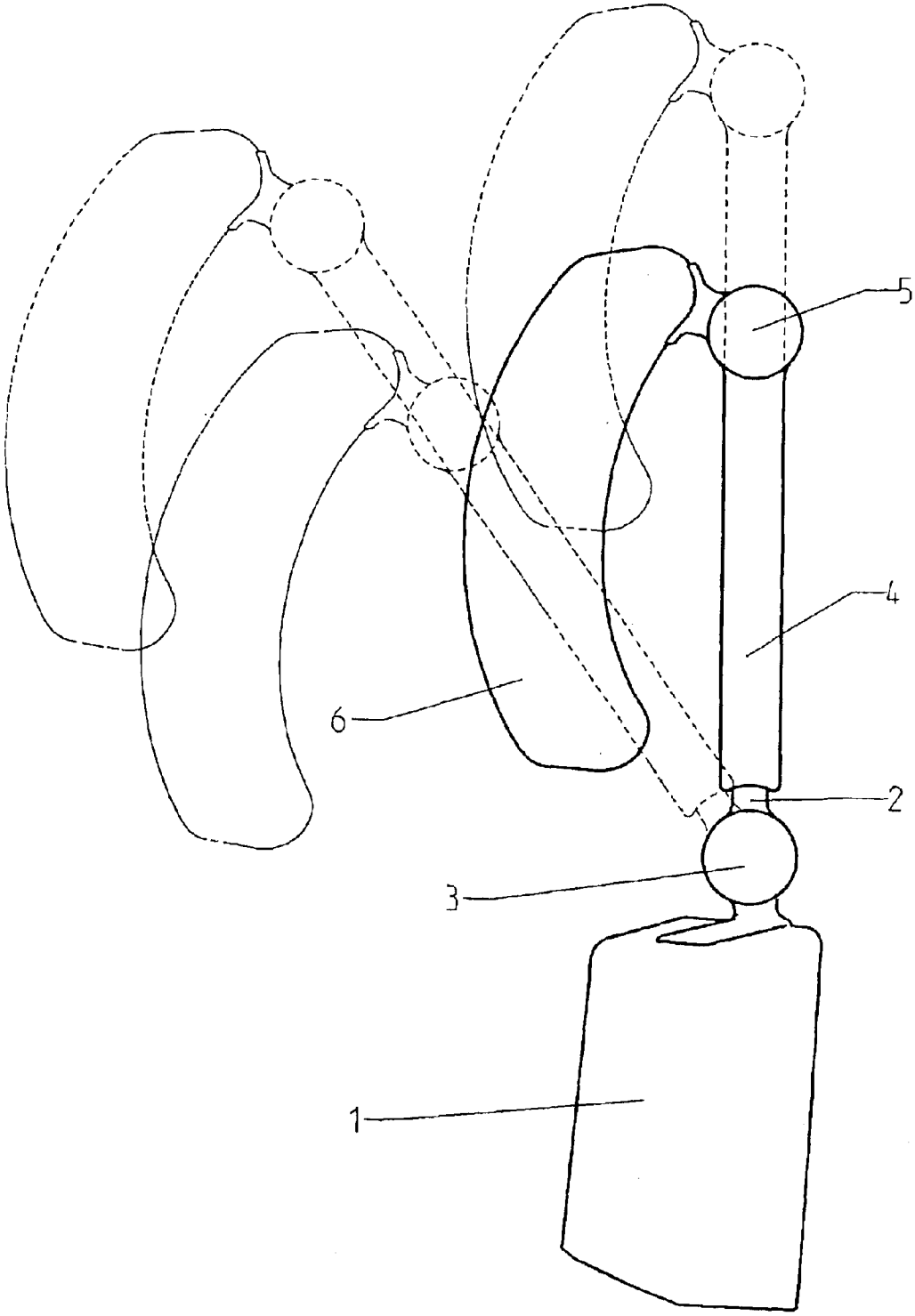
FIG. 1 shows, schematically, the functioning and the adjustment range of the neck support according to the invention.

FIG. 1 illustrates a detail from the top central part of the backrest 1 of a swivel chair for the office, a rectilinear retaining bar 2 being attached thereto via a bottom articulation bearing 3. Arranged in a displaceable manner on this retaining bar 2 is the guide sleeve 4, which has the top articulation bearing 5 at its top end. The head cushion 6 is articulated on said articulation bearing 5 by way of its top part.

Four different possible positions of the head cushion 6 are illustrated:

In the first position, the retaining bar 2 and guide sleeve 4 run in extension of the backrest 1, that is to say vertically upwards in the figure, the guide sleeve 4 assuming its lowest position. In the second position, the guide sleeve 4 is likewise located vertically, but in its highest position.

In the third and fourth positions, the guide sleeve 4 is inclined forwards, and the head cushion 6 is located, in the first case, in the lowest position, and in the second case, in the highest position.

According to the invention, the pivoting range about the bottom articulation bearing 3 should be up to approximately 35°, and that about the top articulation bearing 5 should be up to approximately 40°. The extension length of the guide sleeve 4 out of the retaining bar 2 is approximately 70 mm. This short extension length is possible by virtue of the neck support being fitted on a backrest which can be adjusted not just in respect of inclination but also in respect of height: the rough adjustment can then take place by way of the backrest of the chair, the adjustability of the neck support serving only for precision adjustment. A considerable adjusting range is thus achieved overall.

Figure 2:
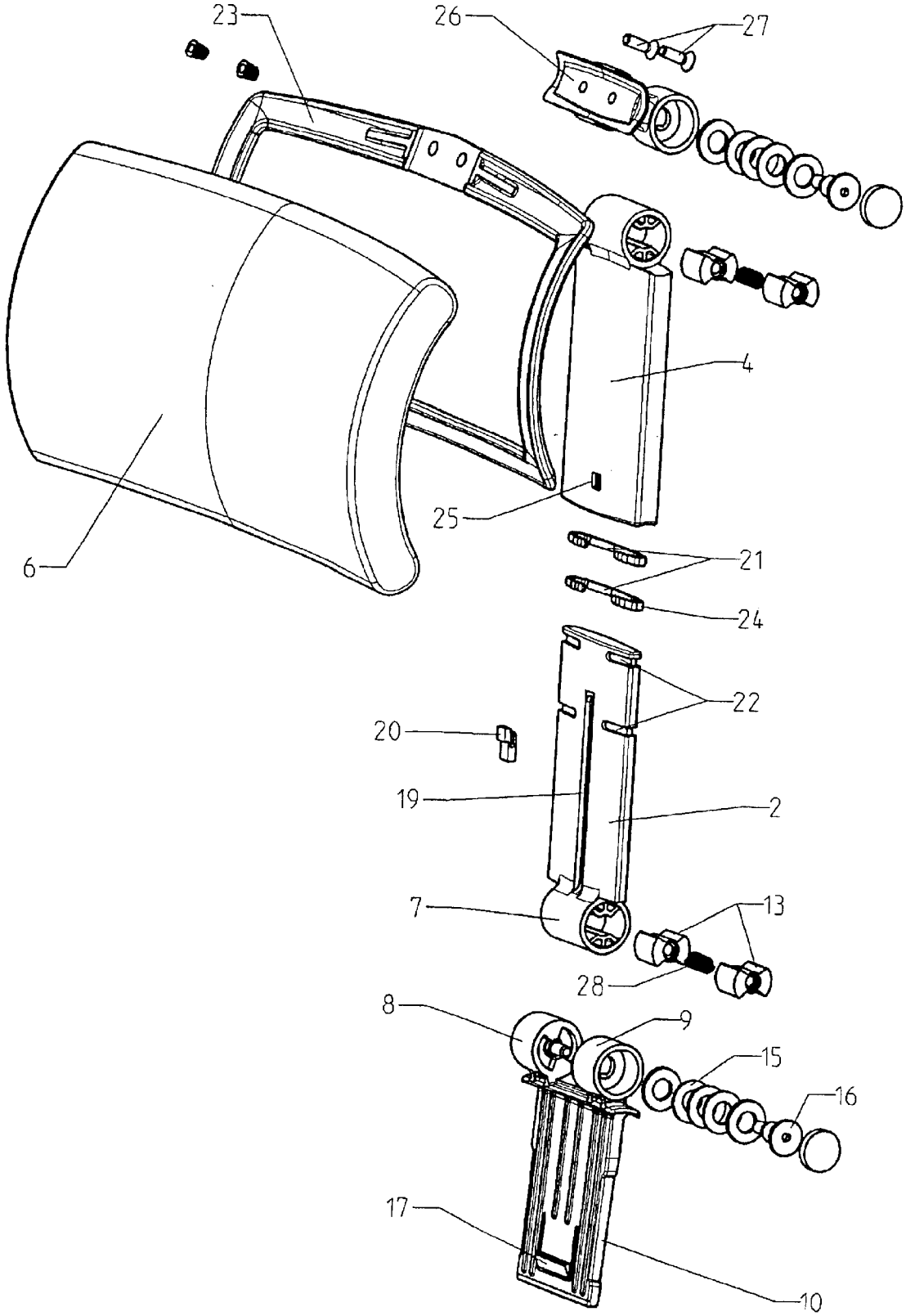
FIG. 2 shows the view of the individual parts of the neck support according to the invention in an exploded illustration.

It can be seen from FIG. 2 that the retaining bar 2 has a cylinder 7 integrally formed at the bottom. In the installed state, the cylinder 7 is located between the cylinder 8 and the cylinder 9, which are both integrally formed at the top end of the bearing foot 10.

Figure 4:
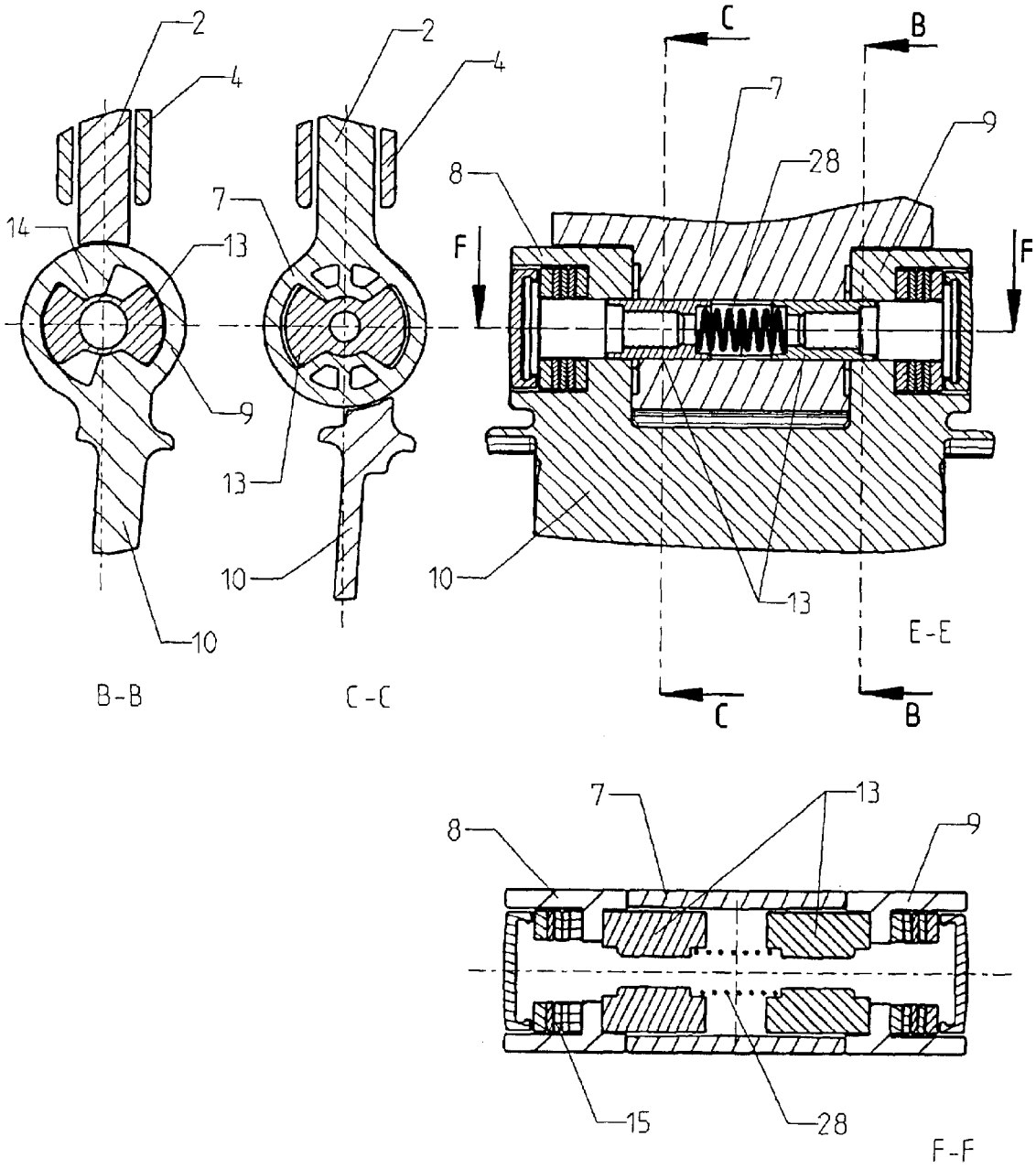
FIG. 4 shows, at the top right, a section through the bearing on the top edge of the backrest and, to the left of and beneath the latter, the sections B—B, C—C and F—F.

For installation purposes, the two blocks 13 are inserted, together with the helical spring 28, into the cylinder 7 and forced against one another. The cylinder 7 is then moved between the cylinders 8 and 9 and the pressure on the spring 28 is eliminated. The blocks 13 thus enter into the cylinders 8 and 9, and the retaining bar 2 is consequently mounted in an articulated manner. As can also be seen from sections B—B and C—C in FIG. 4, in particular, the inner shaping of the cylinder 7 on the retaining bar 2 is such that the blocks 13 cannot rotate. The shaping in the cylinder 8 or 9, however, is such that the blocks 13 have a rotary clearance between the stops 14, this rotary clearance allowing the retaining bar 2 to pivot.

In order that the retaining bar 2 is fixed in each pivoting position set, cup springs 15 are provided in the cylinders 8 and 9, the cup springs being subjected to stressing by means of a clamping screw 16, so that the retaining bar 2 is retained by the resulting friction.

The construction of the top articulation bearing 5 is basically identical to the construction described for the bottom articulation bearing 3. A dedicated description will thus not be given in respect of the top articulation bearing, and the corresponding individual parts are not provided with dedicated designations. This bearing is different, however, in so far as the cylinders corresponding to the cylinders 8 and 9 are fitted on the link plate 26, these being fastened on the frame 23 of the head cushion 6 by means of the screws 27.

The movement of the guide sleeve 4 on the retaining bar 2 is stabilized by the sliding rings 21. These have sliding protrusions 24 and, following installation, engage in the notches 22 of the retaining bar 2. The clip 20 slides in the guide slot 19 and grips in the recess 25 of the guide sleeve 4 by way of its nose, thus serving as a means for preventing withdrawal of the guide sleeve 4 sliding on the retaining bar 2.

It can clearly be seen in FIG. 2 that the head cushion 6 is retained on a frame 23. The frame 23, that preferably consists of plastic, is advantageously encapsulated in polyurethane (PUR) foam in order to produce the head cushion 6. The head cushion 6 thus has a flexible centre and provides enhanced comfort for the user.

Figure 3:
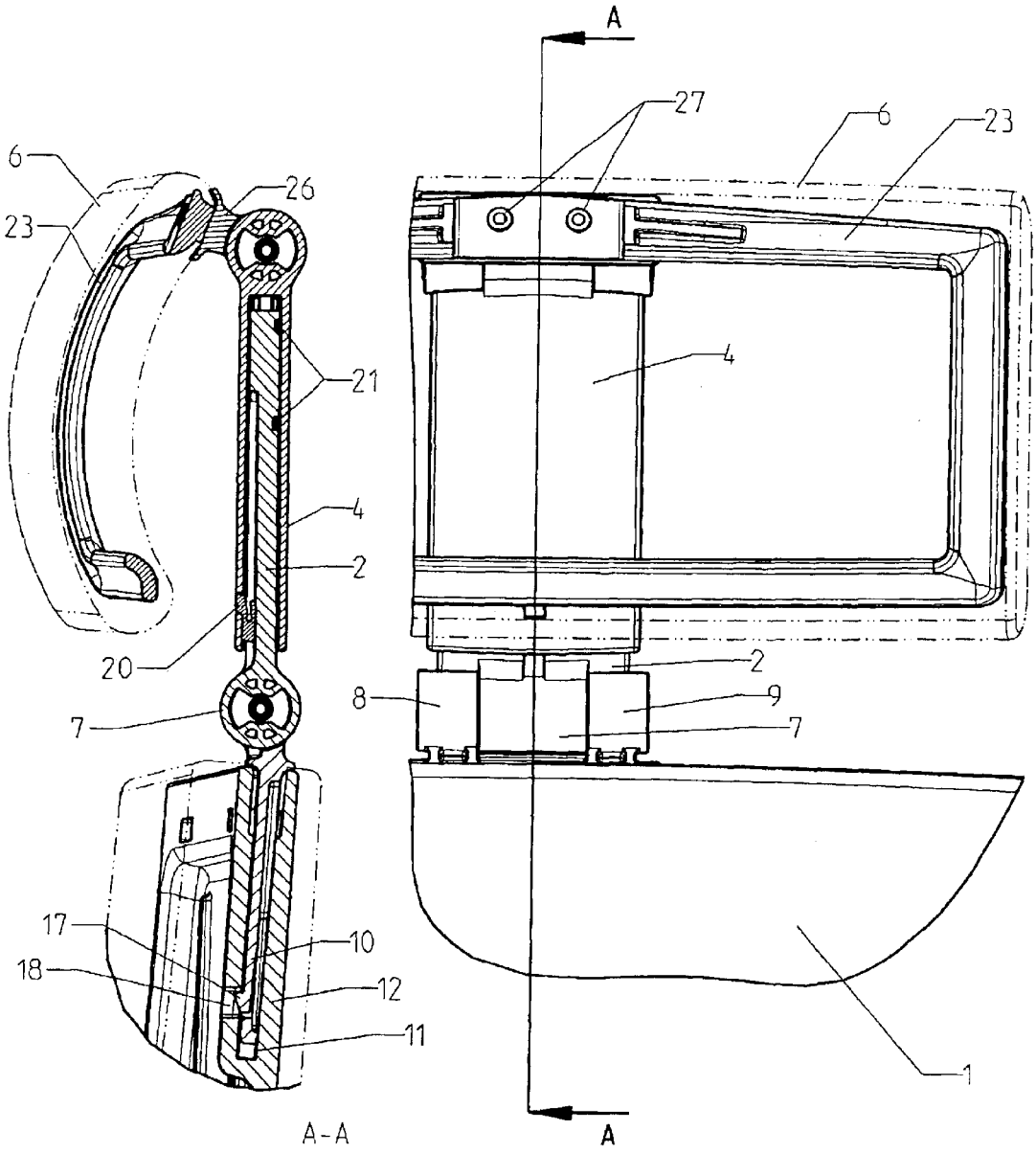
FIG. 3 shows, on the right, the neck support according to the invention in a view from the front and, on the left, the section A—A from the illustration on the right-hand side.

FIG. 3 shows the neck support according to the invention in the installed state. The parts which have already been described are also clearly evident in the installed state and will thus not be described again.

A further description will thus merely be given of the fastening of the bottom articulation bearing 3 in the backrest 1 of the chair:

As can be seen, the bearing foot 10 is inserted in a tongue-like manner in the shaft 11 of the backrest panel 12. As can also be seen from FIG. 2, the bearing foot has a bottom latching nose 17, which latches into the recess 18 of the backrest panel 12 and thus firmly anchors the bearing surface 10. The operation of installing the neck support on the top edge of the backrest 1 is thus extremely straightforward, but nevertheless secure.

FIG. 4, once again, illustrates the details of the bottom bearing 3, which—as has already been said—also correspond to those of the top bearing 5. In particular the function of the blocks 13 in the cylinders 7, 8 and 9 is clearly evident from FIG. 4.

In summary, it should be stated that the neck support according to the invention, by virtue of its linear height adjustment and its pivotability about two bearings, provides an extremely high degree of comfort for the user, but can nevertheless be produced and installed with comparatively low outlay.

List of Designations

1 Backrest
2 Retaining bar
3 Bottom articulation bearing
4 Guide sleeve
5 Top articulation bearing
6 Head cushion
7 First cylinder
8 Second cylinder
9 Third cylinder
10 Bearing foot
11 Shaft
12 Backrest panel
13 Blocks
14 Stops
15 Cup springs
16 Clamping screws
17 Latching nose
18 Recess for latching nose 17
19 Guide slot
20 Clip
21 Sliding ring
22 Notches
23 Frame
24 Protrusions
25 Recess for clip 20
26 Link plate
27 Screws
28 Spring

What is claimed is:

1. Neck support for a chair, having a head cushion on a guide sleeve which can be displaced on a retaining bar, the retaining bar being articulated on the top edge of a backrest of the chair via a first articulation bearing, and the head cushion being articulated on a second articulation bearing at a top end of the guide sleeve, and both the retaining bar and the guide sleeve being of rectilinear design, this resulting in linear height adjustability of the head cushion, wherein the first articulation bearing has a pivoting range of approximately 35° and the second articulation bearing has a pivoting range of approximately 40°, first articulation bearing comprises a first cylinder, which is integrally formed at a bottom of the retaining bar, a second cylinder, and a third cylinder integrally formed at a top of the bearing foot, the bearing foot being configured to be introduced in a tongue like manner into a shaft of a backrest panel, and the first cylinder is configured to rotate between the second cylinder and the third cylinder by means of blocks inserted in an interior of the cylinders.

2. The neck support according to claim 1, wherein a rotary clearance with a stop for the blocks is provided in the interior of the second cylinder and of the third cylinder, and adjustable elements are provided which can be adjusted based on a frictional force and by means of controlling the rotation of the retaining bar in an adjustable manner.

3. The neck support according to claim 1, wherein, at a bottom end of the neck support, the bearing foot has a latching nose configured to be latched into a recess of the shaft of the backrest panel for the purpose of anchoring the bearing foot.

4. The neck support according to claim 1, wherein the retaining bar has a longitudinally running guide slot in which a clip slides in order to prevent withdrawal, the clips engaging in a recess of the guide sleeve by way of a nose of each clip.

5. The neck support according to claim 1, wherein the bottom bearing and the top bearing are of an identical basic construction.

6. The neck support according to claim 1, wherein the head cushion consists of a polyurethane material foamed onto a frame.

* * * * *